US007918740B2

(12) United States Patent
Kitchen et al.

(10) Patent No.: US 7,918,740 B2
(45) Date of Patent: Apr. 5, 2011

(54) BIG WHEEL ROUNDABOUT AMUSEMENT RIDE

(75) Inventors: William J. Kitchen, Windermere, FL (US); John H Chance, La Selva Beach, CA (US)

(73) Assignee: William J. Kitchen, Windermere, FL (US)

( * ) Notice: Subject to any disclaimer, the term of this patent is extended or adjusted under 35 U.S.C. 154(b) by 1169 days.

(21) Appl. No.: 11/559,663

(22) Filed: Nov. 14, 2006

(65) Prior Publication Data

US 2008/0113822 A1 May 15, 2008

(51) Int. Cl.
*A63G 1/34* (2006.01)
*A63G 1/00* (2006.01)

(52) U.S. Cl. ..... 472/36; 472/39; 472/43; 472/47

(58) Field of Classification Search ..... 472/1, 3, 472/29, 30, 32–34, 36, 37, 39, 43–47
See application file for complete search history.

(56) References Cited

U.S. PATENT DOCUMENTS

| | | | | |
|---|---|---|---|---|
| 608,262 | A | 8/1898 | Lord | |
| 646,791 | A | 4/1900 | Bemenderfer | |
| 759,053 | A | 5/1904 | Whittemore | |
| 1,296,417 | A * | 3/1919 | Mangels | 472/37 |
| 2,535,862 | A * | 12/1950 | Pewitt | 472/30 |
| 3,085,516 | A | 4/1963 | Cirami | |
| 3,093,372 | A | 6/1963 | Cirami | |
| 3,120,197 | A | 2/1964 | Cirami | |
| 3,297,319 | A | 1/1967 | Chereau | |
| 3,476,385 | A | 11/1969 | Foy | |
| 3,985,081 | A | 10/1976 | Sullivan, II | |
| 4,503,778 | A | 3/1985 | Wilson | |
| 4,520,732 | A | 6/1985 | Schwarzkopf | |
| 4,690,064 | A | 9/1987 | Owen | |
| 5,203,744 | A | 4/1993 | Checketts | |
| 5,267,906 | A | 12/1993 | Kitchen | |
| 5,272,984 | A | 12/1993 | Bolliger et al. | |
| 5,527,223 | A | 6/1996 | Kitchen | |
| 5,791,254 | A | 8/1998 | Mares et al. | |

(Continued)

FOREIGN PATENT DOCUMENTS

DE 8712286 10/1987

(Continued)

OTHER PUBLICATIONS

Written Opinion of International Search Report—mailed Sep. 29, 2006 Application No. US2006/019409 Dated: May 18, 2006 Applicant: William J. Kitchen Corresponding PCT Application.

(Continued)

*Primary Examiner* — Kien T Nguyen
(74) *Attorney, Agent, or Firm* — Margaret Polson; Oppedahl Patent Law Firm LLC

(57) ABSTRACT

A circular track may be flat or hilly. Riding on the track is a big wheel sized larger than a rider compartment. The rider compartment is supported out bound from the big wheel's axle. The big wheel's inbound axle is attached to a radius arm which is powered by a conventional rotating hub. The radius arms are pivotally connected to the hub to allow an up and down movement on a hilly track. The rider compartment has a magnetic coupler assembly to the axle to enable an automatic and/or a rider controlled head over heels spinning of the rider compartment while the big wheel is traveling in its circular path around the hub.

22 Claims, 15 Drawing Sheets

U.S. PATENT DOCUMENTS

| | | | |
|---|---|---|---|
| 5,931,740 | A | 8/1999 | Kitchen |
| 5,967,938 | A | 10/1999 | Benford et al. |
| 5,979,333 | A | 11/1999 | Houben et al. |
| 6,047,645 | A | 4/2000 | Cornwell et al. |
| 6,098,549 | A | 8/2000 | Mares |
| 6,158,354 | A | 12/2000 | Eiraku |
| 6,227,121 | B1 | 5/2001 | Mares |
| 6,269,749 | B1 | 8/2001 | Hogg |
| 6,269,750 | B1 | 8/2001 | Cornwell et al. |
| 6,386,115 | B2 | 5/2002 | Mares |
| 6,402,624 | B1 | 6/2002 | Larson et al. |
| 6,440,002 | B1 | 8/2002 | Jackson |
| 6,477,961 | B1 | 11/2002 | Mares |
| 6,523,479 | B1 | 2/2003 | Schilke et al. |
| 6,565,106 | B2 | 5/2003 | Lopez |
| 6,606,953 | B2 | 8/2003 | Mares |
| 6,622,634 | B2 | 9/2003 | Cylvick |
| 6,830,258 | B2 | 12/2004 | Foley |
| 6,840,136 | B1 | 1/2005 | Jones |
| 2003/0172834 | A1 | 9/2003 | De-Gol |
| 2006/0178221 | A1 | 8/2006 | Threlkel |
| 2007/0010336 | A1 | 1/2007 | Kitchen |

FOREIGN PATENT DOCUMENTS

| | | |
|---|---|---|
| FR | 1602703 | 1/1971 |
| FR | 2098914 | 10/1972 |
| FR | 2599988 | 12/1987 |
| FR | 2700967 | 8/1994 |
| GB | 04830 | 12/1909 |
| JP | 5115618 | 5/1993 |
| WO | 03082421 | 10/2003 |

OTHER PUBLICATIONS

Velocity Magnetics, Inc., Dyna-Brake from Velocity Magnetic, pp. 1-2 see: http://www.velocitymagnetics.com/.

International Search Report and Written Opinion of the International Searching Authority in related PCT Application No. PCT/US2007/084395 filed Dec. 11, 2007.

Office Action received in related U.S. Appl. No. 11/419,170, filed May 18, 2006; First name inventor: William J. Kitchen.

International Search Report and Written Opinion of the International Searching Authority in related PCT application No. PCT/US2006/019409 filed May 18, 2006.

International Search Report and Written Opinion of the International Searching Authority in related PCT application No. PCT/US2007/084395 filed Nov. 12, 2007.

Amendment in response to office action mailed Apr. 25, 2008 in related U.S. Appl. No. 11/419,170, filed May 18, 2006; first name inventor: William J. Kitchen.

Office action received in related U.S. Appl. No. 11/419,170, filed May 18, 2006; first name inventor: William J. Kitchen.

Examiner interview summary in related U.S. Appl. No. 11/419,170, filed May 18, 2006; first name inventor: William J. Kitchen.

Amendment After Final in related U.S. Appl. No. 11/419,170, filed May 18, 2006; first name inventor: William J. Kitchen.

* cited by examiner

BIG WHEEL ROUNDABOUT AMUSEMENT RIDE

FIELD OF INVENTION

The present invention relates to a centrally driven roundabout amusement ride and/or people mover, wherein a large wheel travels along a track, the wheel's outer axle supporting a rider compartment, and the wheel being driven by a radius arm of a rotating hub.

BACKGROUND OF THE INVENTION

Some amusement devices, including roller coasters, attempt to deliver additional systems of rotation other than the movement of the vehicle on the track system. Examples of amusement rides which provide some rotation capabilities with or without passenger control are various patents to Mares including U.S. Pat. Nos. 5,791,254, 6,098,549 and 6,227,121.

WO 03/082421 teaches an amusement ride, such as a roller coaster or a vertical track ride, which enables full rotation in at least two planes or axes, and preferably all three planes or axes.

The WO 03/082421 amusement ride generally comprises a track system, which may be an endless roller track or at least one vertical tower track. An attachment assembly, such as a bogey, is movably connected to the track system. A vehicle assembly is connected to the attachment assembly and includes a seat assembly having at least one rider seat. The vehicle assembly includes means for fully rotating the seat assembly about first, second and third axes independent of the track system, and preferably independent of one another.

In one 421 embodiment, the vehicle system includes a first arm extending from the attachment assembly and operably coupled to an actuator such that the first arm is freely or selectively rotatable about a first axis. The firm arm may comprise a generally semi-circular arm attached to a yaw actuator whereby yaw rotation is imparted to the arm. Alternatively, the first arm comprises a shaft extending from the attachment assembly and coupled to a yaw actuator. A second arm is rotatably connected to the first arm by an actuator such that the second arm is freely or selectively rotatable about a second axis independent of the first arm. Typically, the second arm extends generally transverse from an end portion of the first arm and supports at least one seat assembly. A roll actuator is operably connected to each seat assembly such that roll rotation is imparted to the seat assembly. Thus, the seat assembly is capable of yaw, pitch, and roll rotations over all three axes.

In another 421 embodiment, the vehicle assembly comprises a generally circular main ring housing that is rotatably connected to the attachment assembly. Typically, a yaw gear of a gear assembly interconnects the attachment assembly and the vehicle assembly whereby yaw rotation is imparted to the main ring housing, and thus the seat assembly. A pitch arm extends between opposing sides of the main ring housing and supports the seat assembly. The pitch arm is rotatable along a second axis independent of the track system. A gear of the pitch bar mates with a pitch gear of the gear assembly to impart such pitch rotation. A split inner race assembly including rollers is disposed within the main ring housing and connected to the pitch bar. The split inner race assembly is operably coupled to a roll gear of the gear assembly, whereby roll rotation is imparted to the split inner race assembly, and thus the seat assembly.

In another 421 embodiment, the vehicle assembly comprises an arm extending from the attachment assembly, such as a semi-circular arm, which is rotationally coupled to a gyroscope assembly that supports the one or more seats of the seat assembly therein. The gyroscope structure or assembly comprises a first generally circular ring coupled to the semi-circular arm by an actuator that imparts rotation to it, and thus the seat assembly, about a first axis. A second generally circular ring is disposed within the first ring and is coupled thereto by an actuator that imparts rotation about a second axis. A third ring may be used which is disposed within the second ring and rotatably coupled to the second ring by an actuator that imparts rotation to the seat assembly about a third axis. Alternatively, the arm is rotatably coupled to the attachment assembly to provide the third degree of rotation.

The important aspect of this 421 invention is that the seats be fully rotatable in at least two, and preferably all three, planes or axes. Although such rotation may be free and dependent upon the change of acceleration placed upon the seat assembly, typically the actuators are mechanically driven or powered to selectively rotate the seat assembly. When powered, the rotation of the seat may be altered by pre-defined programs or even rider control.

A historic summary of relevant prior art patents follows below:

U.S. Pat. No. 3,120,197 (1964) to Cirami discloses a ground-traveling people-carrying robot with a pilot track used for steerage. A power rail supplies electric power to the motorized robot. A yoke arm from the robot has a wheel connection to the power rail and a roller clamp connection to the pilot track.

French Patent 2098914 (1972) discloses a central pivot merry-go-round type ride having peripheral tires which rock a rider compartment. Each outer tire has an outer axle which supports a rod which carries the rider compartment.

U.S. Pat. No. 3,985,081 (1976) to Sullivan, II discloses a people mover mounted on a post with a horizontal top rail, wherein the supporting sides of the top rail are used for supporting canted weight-bearing wheels. A rider compartment is supported outbound of the post (FIGS. 1, 2,) by a strut (20) supported by the wheels.

French Patent 2599988 (1987) discloses a roller coaster concave track, wherein a large ball rolls down the track. Passengers are seated inside the large ball.

U.S. Pat. No. 6,047,645 (2000) discloses a square roller coaster truss track, and FIG. 4 discloses a three-tube truss track. There are two parallel running rails 52, 54 which support (see FIG. 10) a chassis beam with a rail clamp at each end. Each rail clamp has an array of three wheels to ride along the rail. Thus, the passenger compartment, which is side-mounted to the running rails 52, 54, is supported by the two arrays of wheels and the interconnecting chassis beam. A single support rail 56 runs parallel to the two running rails 52, 54 and has interconnected frame elements 60 to secure the three-tube truss track together.

FR 2.098.914 discloses a circular duck ride. The rider support wheels are attached to a circular frame. Each wheel has an axle projecting outbound with the duck shaped rider carriage mounted on the end of the axle. The rider support wheels roll over the ground.

Pub. No. U.S. 2003/0172834 discloses a circular track having self propelled robots used as people movers. See also U.S. Pat. No. 6,871,596, JP2003260273, DE10203729, EP1332779.

U.S. Pat. No. 759,053 (1904) to Whittlemore discloses a large, drum shaped skeleton type wheel having an axle which rides on elevated rails of a roller coaster. A single, lower rail supports a grooved guide on a central ring of the wheel. Riders can rock in a freely hanging car in the center of the wheel.

U.S. Pat. No. 995,945 (1911) to Berhold discloses a giant barrel that rolls down a track and then floats on water. The rider seat is suspended inside the barrel via the axle.

U.S. Pat. No. 5,319,897 (1994) to Royer discloses a ferris wheel type ride where the axel is reciprocated.

U.S. Pat. No. 5,527,221 (1996) to Brown et al. discloses a hilly track having dollies, each dolly carrying a seat that can rotate in a horizontal plane.

U.S. Pat. No. 5,595,121 (1997) to Elliott et al. discloses an oval track with self propelled people movers having powerful electric motors to achieve high acceleration forward or backward.

U.S. Pat. No. 6,523,479 (2003) to Schilke et al. discloses a roller coaster ride with a pair of spinning rider carriages extending left and right from the vehicle. The spacing between guide rails determines the spinning torque.

JP2005328897 discloses a merri-go-round type ride with rotating rider vehicles.

GB432050 (1935) discloses a roundabout ride having a pair of concentric tracks. The tracks are waved to make the cars go up and down. Radial sweep arms move the cars in the circular path of the tracks.

GB320758 (1929) discloses a roundabout ride on a single track. The tracks are waved to make the cars go up and down. Radical sweep arms move the cars in the circular path of the track. Small metal wheels run on the track.

The present invention provides a relatively quiet, smooth yet exhilarating ride. Furthermore, the ride can be built relatively inexpensively. The circular track can be designed for the level of excitement desired, from flat to hilly layouts. A central hub powers radius arms, each of which drives a big wheel rider conveyance. A ferris wheel type rocking motion is included combined with a high speed up and down thrill. An optional "flip the rider in a full circle" feature may be included. Also the rider is not encased in a car, but rather sitting exposed to the surroundings. This free flight and relatively quiet ride creates a bird-like feeling unique in amusement rides.

SUMMARY OF THE INVENTION

An aspect of the present invention is to provide a large wheel running over a circular track so as to support a rider compartment from the axle.

Another aspect of the present invention is to provide the running circular track with a flat or a hilly path.

Another aspect of the present invention is to design the wheel axle to be the support for a rider compartment.

Another aspect of the present invention is to design the rider compartment into a side-by-side pair of seats that let the rider fly freely through the air.

Another aspect of the present invention is to provide a flipping (head over heels or forward or backward somersault) feature for the rider compartment.

Other aspects of this invention will appear from the following description and appended claims, reference being made to the accompanying drawings forming a part of this specification wherein like reference characters designate corresponding parts in the several views.

The wheel support rail is a pipe about four inches wide with the large wheel being also about four inches wide. A quiet, smooth weight-bearing wheel is designed. The wheel axle extends several feet off to the side of the wheel to provide a support for a pair of seats, external from the powered radius arms.

A shield may separate the large wheel from the rider seats. In this circular roundabout ride the riders fly around the circular course with nothing in front of them. They will also rock back and forth (optionally) with a gimbaled axle and/or spin. Thus, each ride should be somewhat different with the rocking motion, and each ride should be stimulating at high speeds with nothing in front of the rider.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
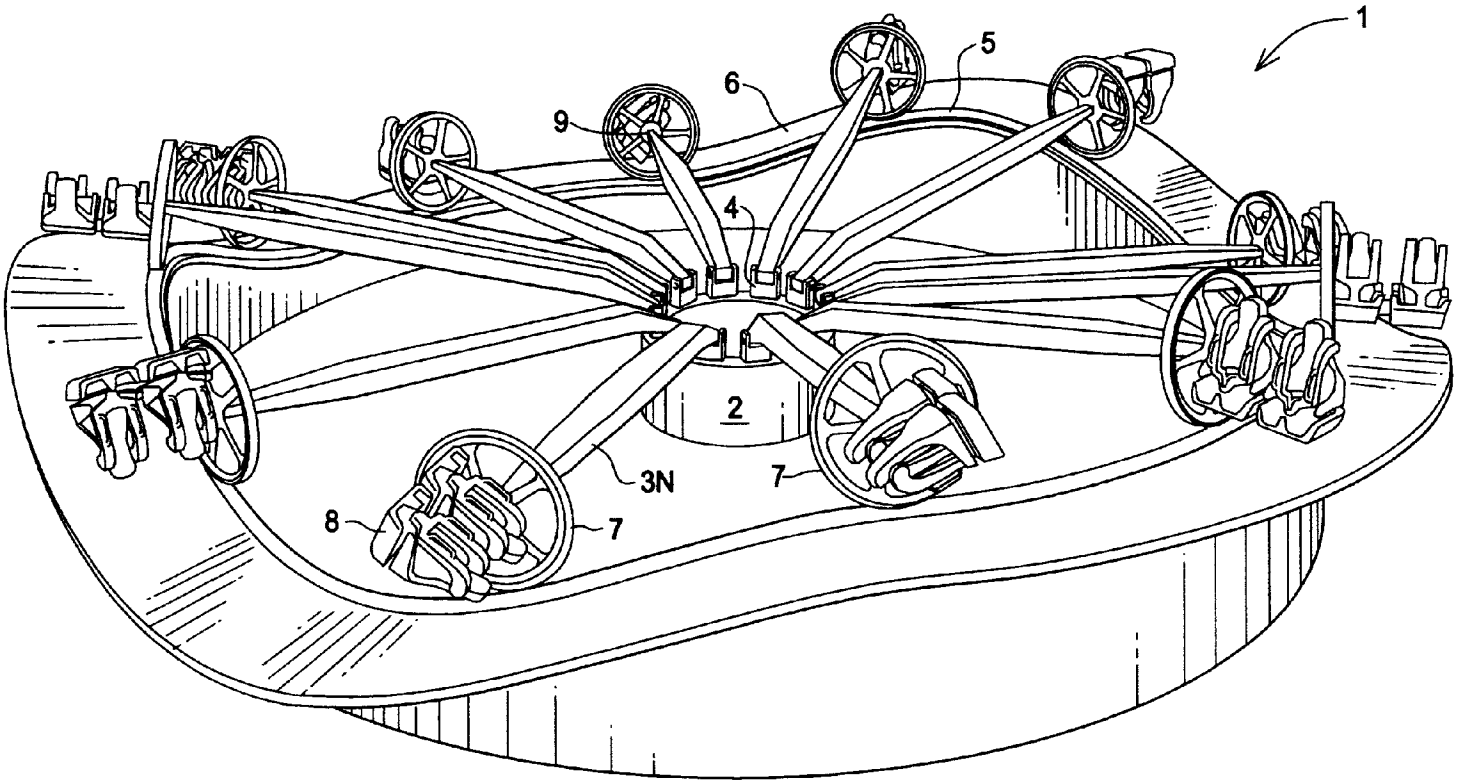
FIG. 1 is a top perspective view of roundabout ride with an apron under the rider carriage.

Referring first to FIG. 1 a roundabout ride 1 consists of a powered hub 2, a plurality of radius arms $\mathbf{3}_N$, each radius arm having a pivotal connection 4 to the hub 2, and the outbound end of each radius arm being connected to an axle assembly 9 of a big wheel 7. The big wheel 7 rides on a support track 5. The support track 5 may be flat or, as shown, it may be hilly. An optional apron 6 extends from the support track 5 under the rider carriage 8. The ride 1 has n=12, but any design choice is encompassed by the present invention.

The axle assembly 9 provides a gimbaled support for the rider conveyance 8 as well as a magnetic coupler to provide a head over heels spinning of the rider conveyance once the ride is up to operating rotational speed.

Figure 2:
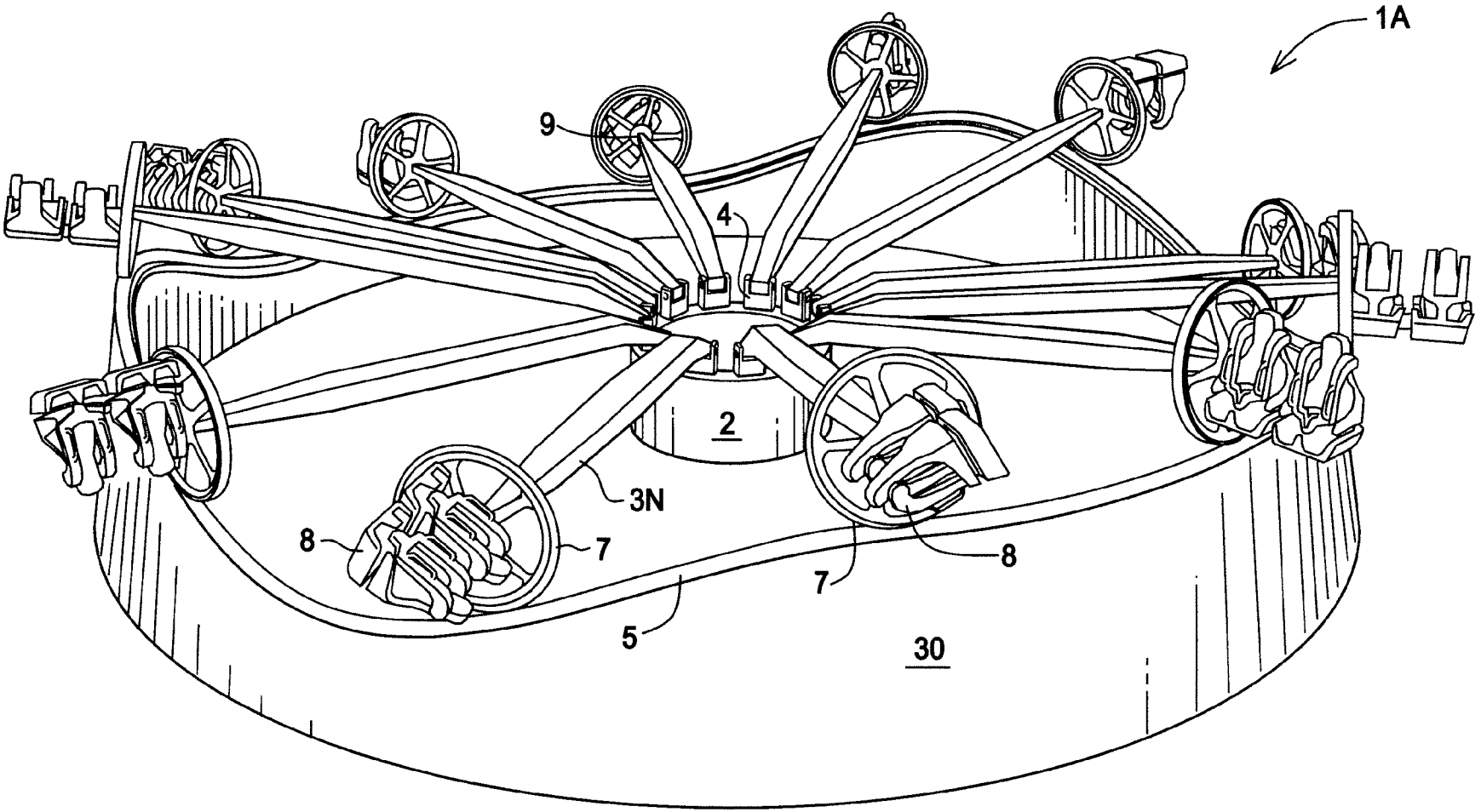
FIG. 2 is a side perspective view of a roundabout ride without an apron.

Referring next to FIG. 2 the roundabout ride 1A is the same as ride 1, but the apron 6 has been eliminated. Various rider conveyances are shown at varying degrees of forward spin.

Figure 3:
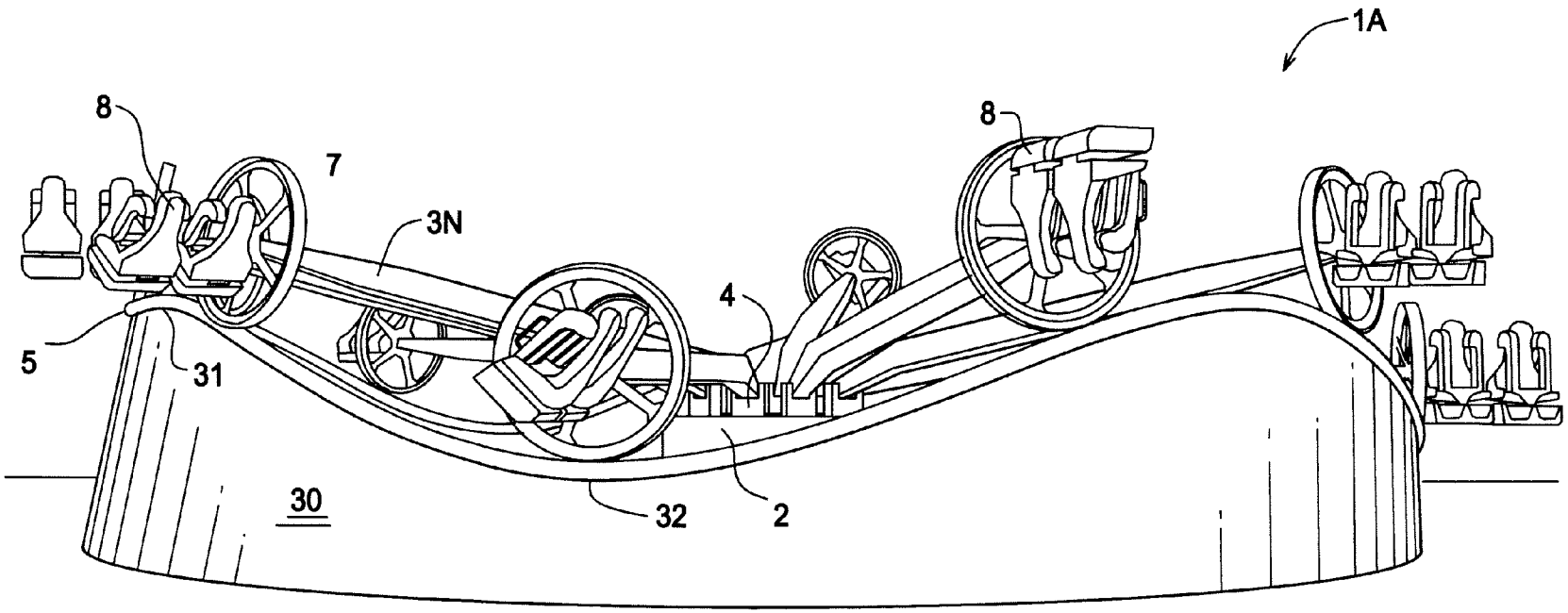
FIG. 3 is a side plan view of the FIG. 2 embodiment showing the rider compartments spinning.

Referring next to FIG. 3 the track 5 is supported by a wall 30 having peaks 31 and troughs 32 to provide a hilly course for track 5. The ground G supports the wall 30.

Figure 4A:
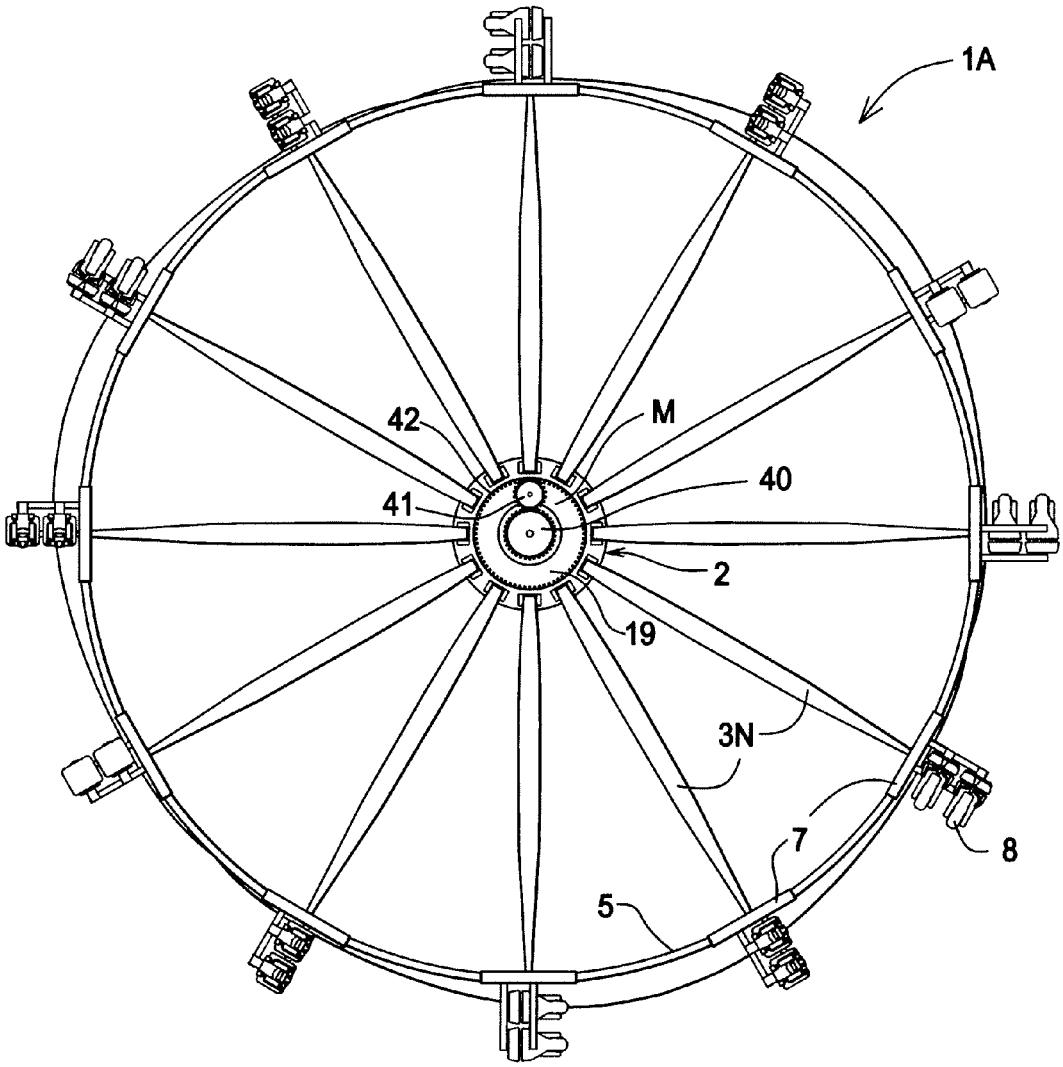
FIG. 4A is a top plan view of the FIG. 2 embodiment.
Figure 4B:
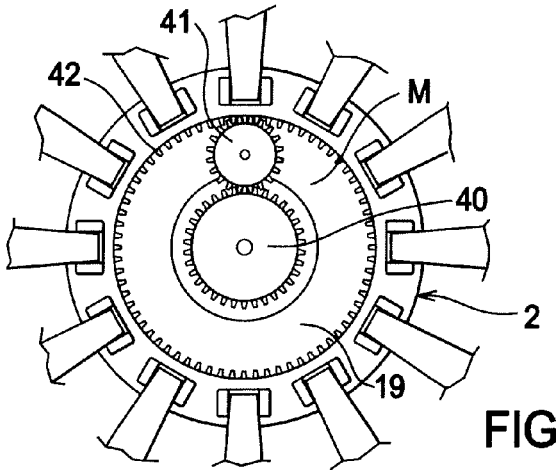
FIG. 4B is a top plan view of the workings of the hub.

Referring next to FIGS. 4A, 4B the ride 1A has radius arms $3_N$ with a nominal radius length of about 25 to 50 feet and a speed of rotation of about 6-15 rotations per minute. The hub 2 is prior art with a drive motor M having an armature gear 40 driving a pinion gear 41 which in turn drives a ring gear 42 on the inside 19 of the hub 2.

Figure 5:
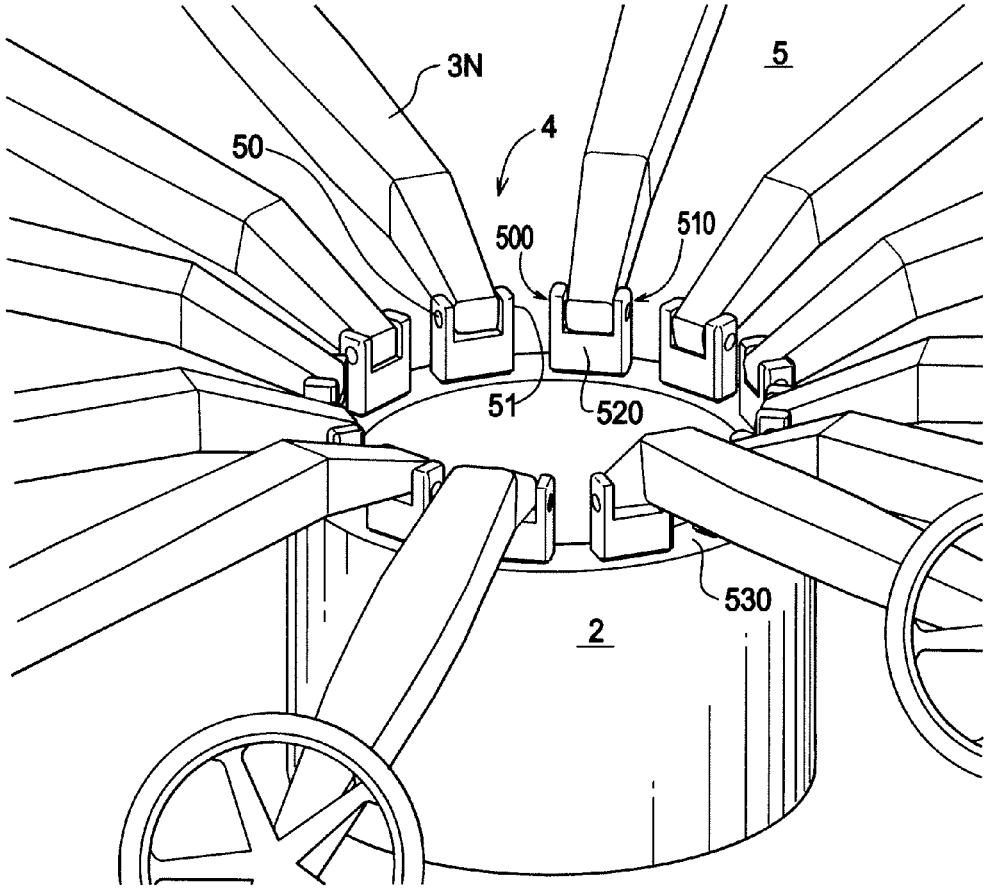
FIG. 5 is a top perspective view of the pivotal connection of the hub.

Referring next to FIG. 5 the hub 2 can be a rotating vertical support cylinder as shown. Each radius arm $3_N$ has support pins 50, 51 at its inbound end. The support pins 50, 51 are pivotally mounted in mounting holes 510, 500 respectively at the top of a support block 520. The support block 520 is mounted to the top ridge 530 of the hub 2.

Figure 6:
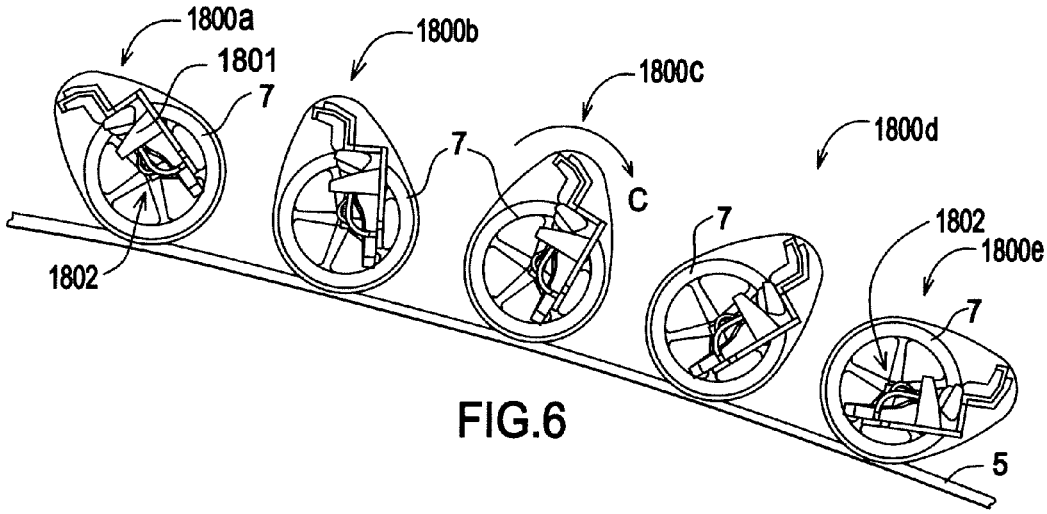
FIG. 6 is a side plan sequence view of the rider carriage spinning.

Referring next to FIG. 6 the flip feature has been added to each rider carriage 8, wherein each rider compartment 1801 is rotated clockwise C as powered by the rotation of the big wheel 7. A reduction gear hub assembly 1802 is actuated either by a rider control switch and/or a track 5 mounted remote activator. Numbers 1800 *a-e* represent a stage of flip. The hub assembly 1802 nominally has about a 3:1 reduction gear ratio of the rotation of the big wheel 7 to the axle 24 (FIG. 7) of the hub assembly 1802. On embodiment has a rider switch to hit "flip", and if the big wheel 7 has sufficient rotational speed, the engagement of the hub assembly 1802 to the axle 24 of the rider compartment 1801 flips the rider compartment clockwise one rotation with the big wheel 7. If not enough speed exists of the big wheel 7, then the rider conveyance 1801 rocks like a ferris wheel rider compartment. Another embodiment has a remote signal, perhaps track mounted, to activate a flip cycle at selected portions of the layout. Another embodiment allows the rider to deactivate the "flip" cycle via a switch.

Figure 7:
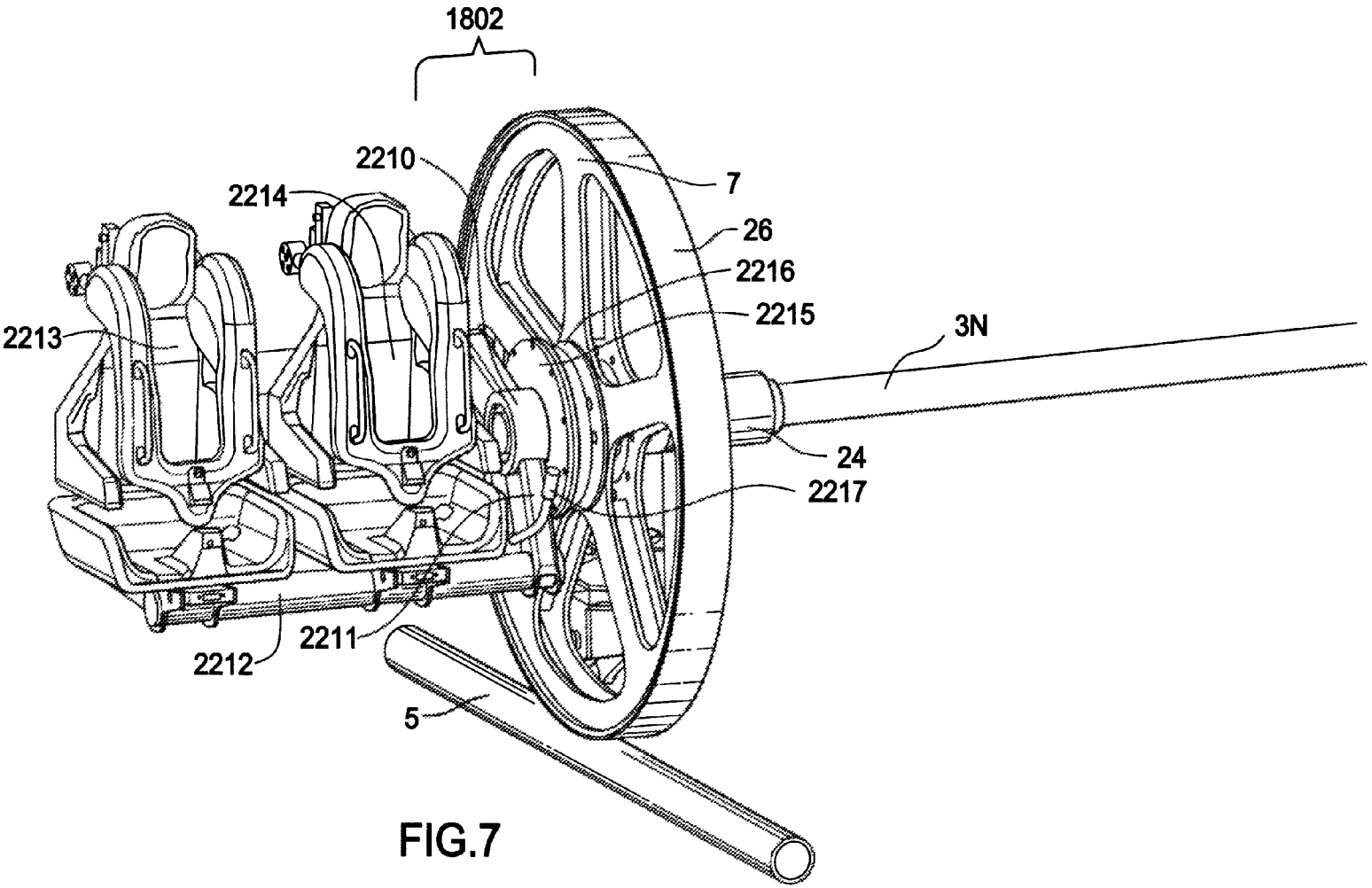
FIG. 7 is a front perspective view of the rider carriage and big wheel.
Figure 8:
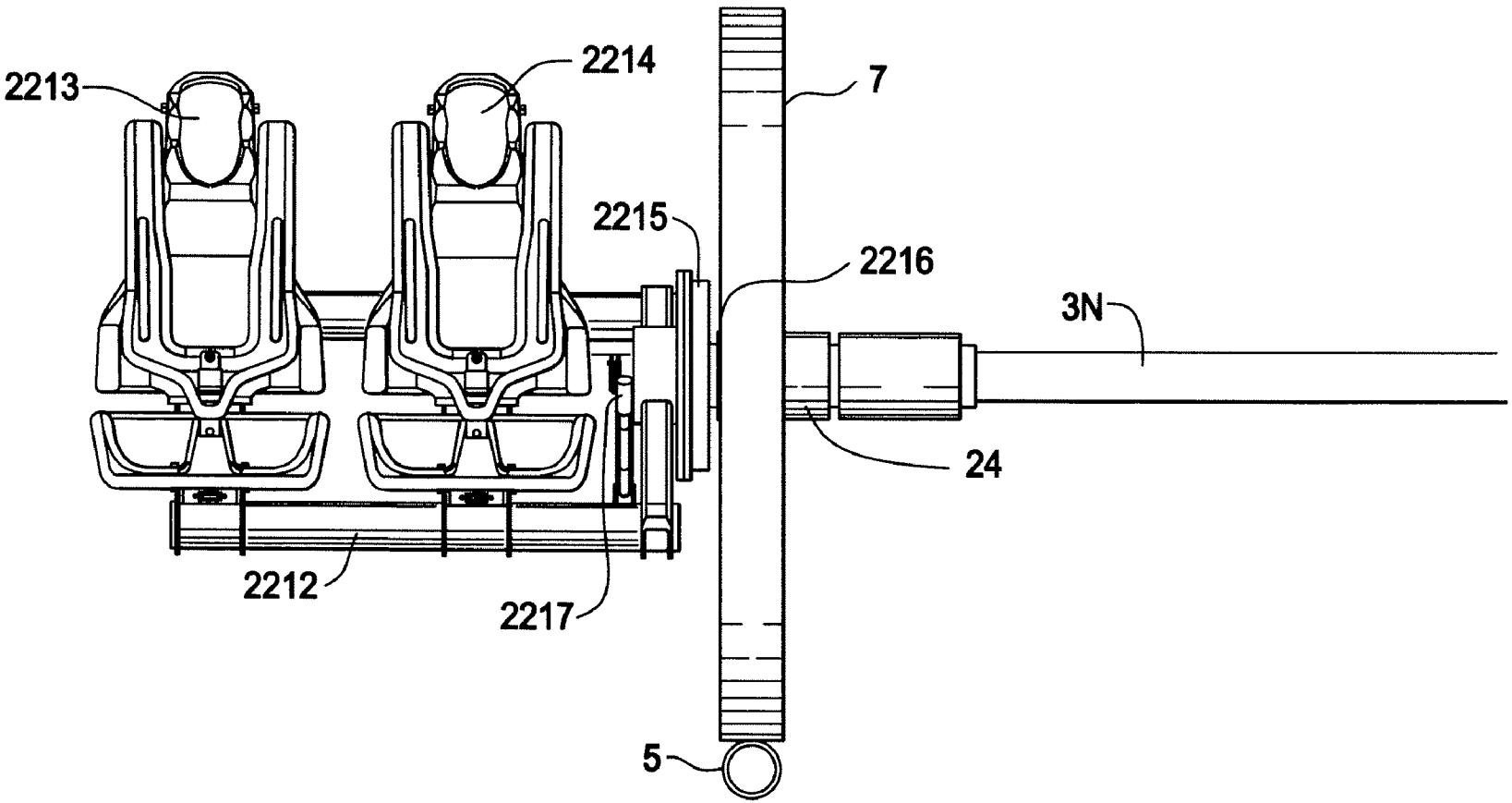
FIG. 8 is a front plan view of the rider carriage and big wheel.
Figure 9:
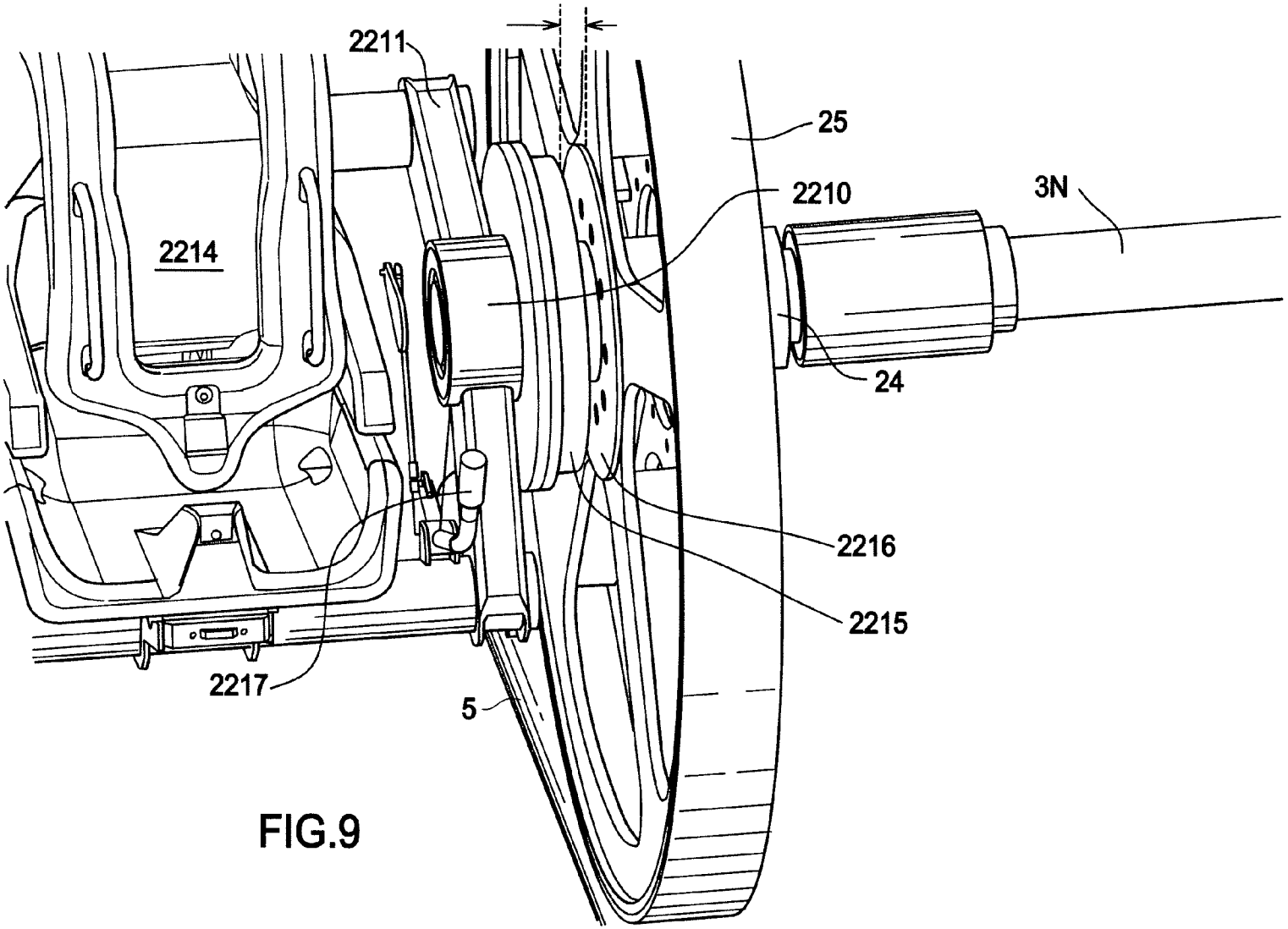
FIG. 9 is a close up view of the spin assembly.

Referring next to FIG. 7 a conveyance assembly 2200 comprises track 5 assembly 2201 which supports a big wheel 7 with a tread 26 that rides on track 5. The axle 24 supports a bearing 2210 which in turn supports a conveyance frame 2211. The frame 2211 includes a support bar 2212 upon which rider seats 2213, 2214 are mounted.

The bearing 2210 has attached to it a plate shaped magnet 2215. The stator 2216 is permanently affixed to the wheel 25. Control handle 2217 allows a rider to move the magnet 2215 and bearing 2210 toward the stator 2216. When the magnet 2215 connects to the stator 2216, the bearing 2210 and frame 2211 rotate with the big wheel 7.

The frame 2211 can either spin 360° and/or rock back and forth, depending on design force. When the magnet 2215 is close to the stator 2216, then the frame 2211 will rock back and forth as the stator 2216 partially propels the frame 2211 in the direction of motion of the big wheel 7.

Referring next to FIGS. 8, 9, 10, 11, 12 the moving magnetic assembly is designated 3000. The fixed stator 2216 is affixed to the big wheel 7. The magnet 2215 moves toward and away from the stator 2216 as controlled by the rider's joy stick 2217. Not shown are optional remote triggers for the actuation of moving the magnet 2215 towards the stator 2216. A remote trigger could consist of a radio transmitter mounted to the track to emit a signal. A receiver gets the command signal and moves the magnet 2215 toward the stator 2216 using a hydraulic actuator instead of the joy stick 2217.

The joy stick 2217 has a pivot connection 3007 to the frame 2211. When the rider pushes the joy stick 2217 forward, the connecting rod 3008 pushes the cam roller 3009 up. When the cam roller 3009 is forced up, then its actuator rod 3004 rides up cam slot 3003 of the cam plate(s) 3002. The cam plate(s) 3002 are affixed to a thrust plate 3035 which in turn is attached to the magnet 2215. The thrust plate 3035 moves away from the frame 2211 and toward the stator 2216. If enough speed is underway by big wheel 7, then the magnet will spin the frame 2211 forward. If not enough speed is underway, then the magnet 2215 will rock the frame 2211. Not shown is an optional hydraulic booster for the connecting rod 3008.

Figure 10:
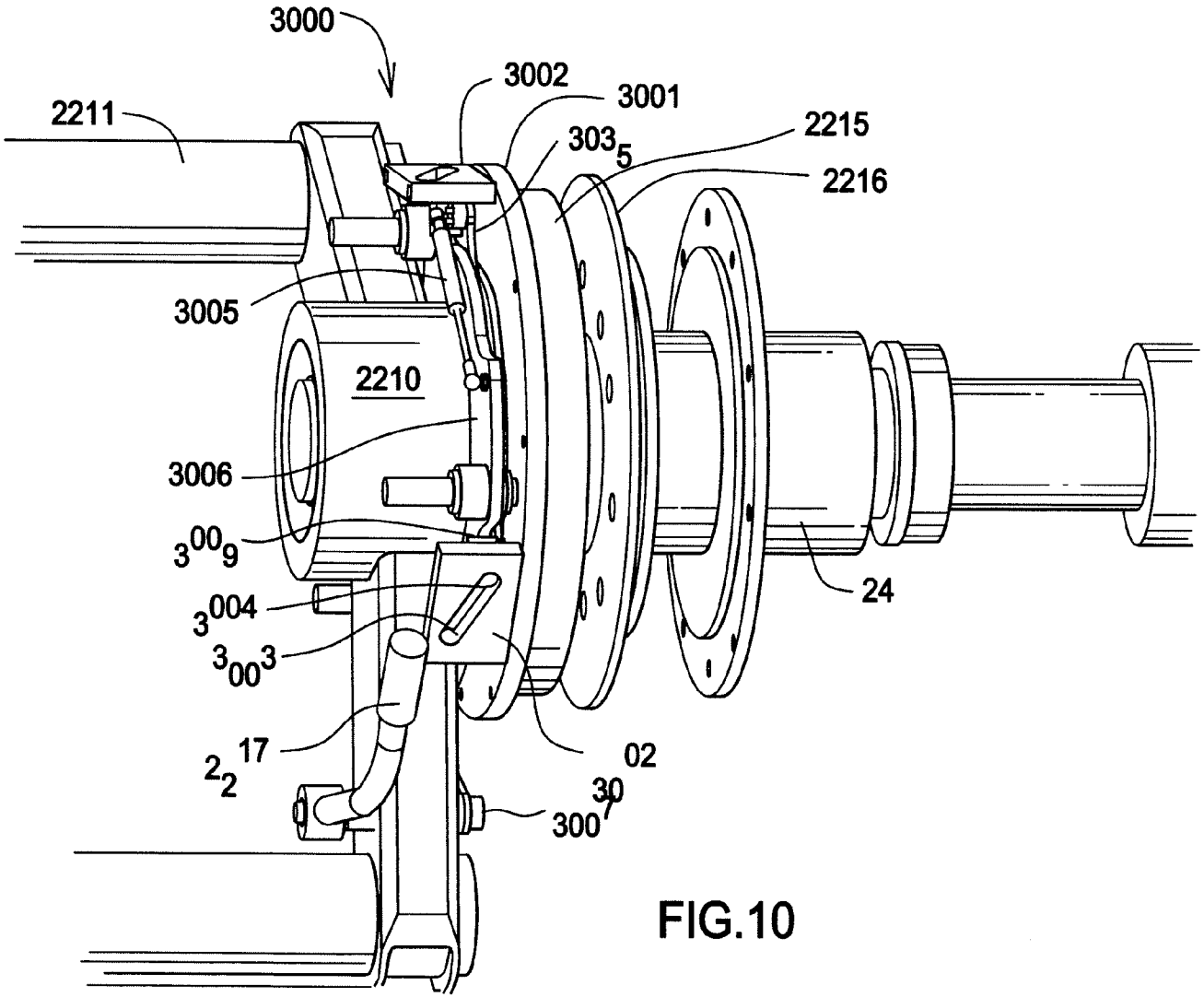
FIG. 10 is a close up view of the spin assembly.
Figure 11:
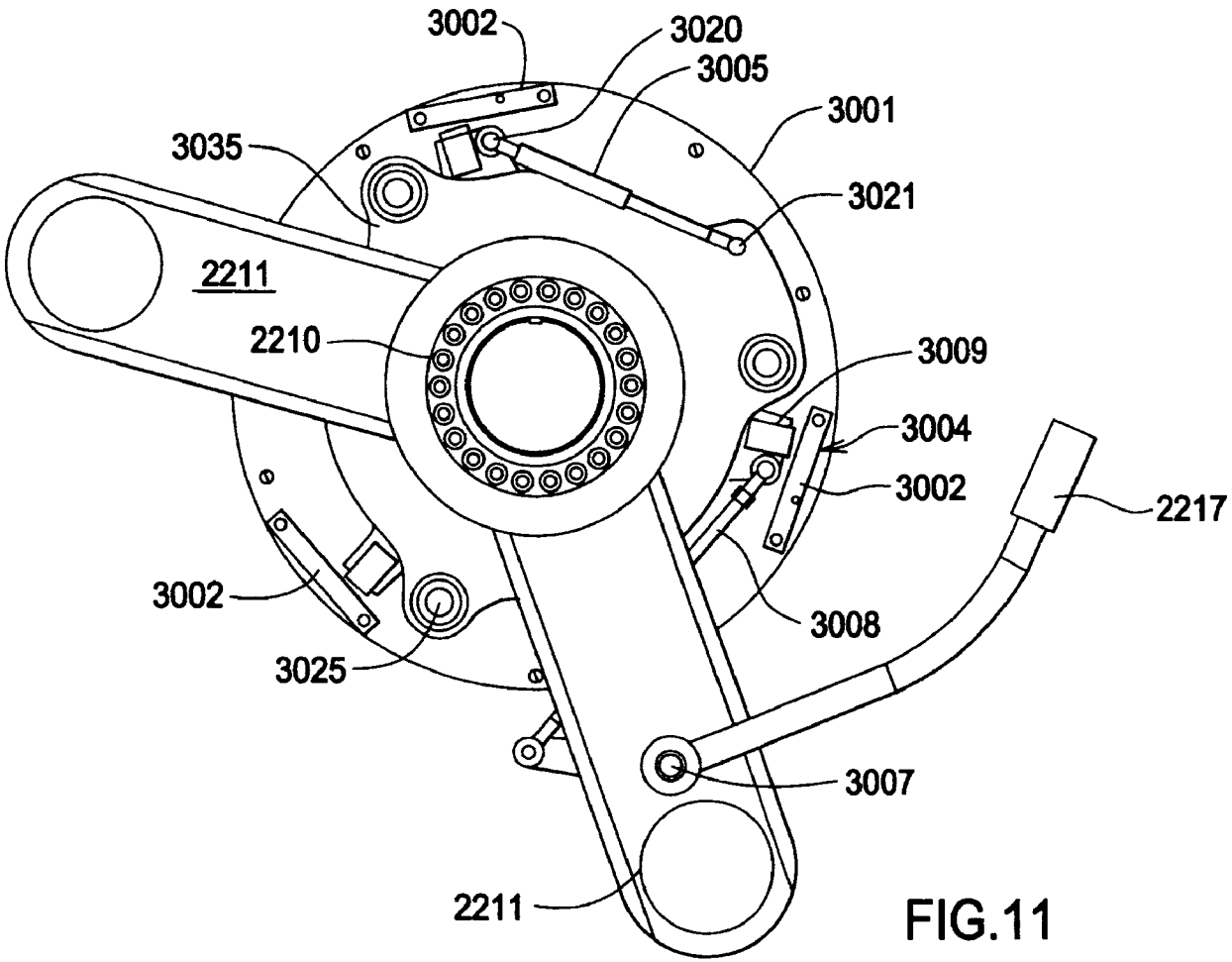
FIG. 11 is a side plan view of the spin assembly.

When the joy stick 2217 is released the return gas spring 3005 back down to its disengaged position. FIG. 10 shows the thrust plate 3035 and magnet 2215 engaged for a spin.

Thrust plated pins 3025 slidably engage linear bearings 3026 to direct the thrust plate 3035 toward and away from stator 2216.

Figure 12:
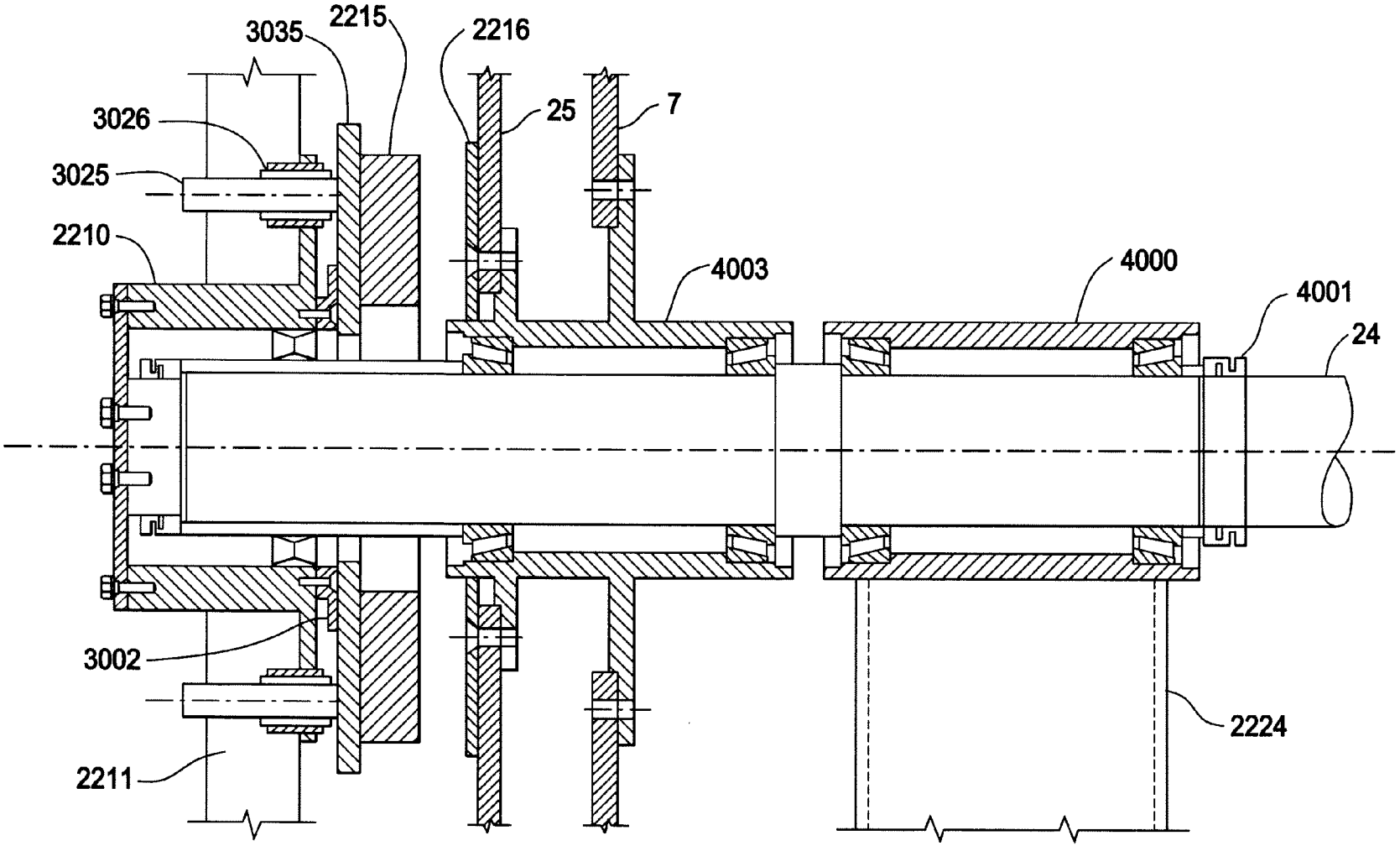
FIG. 12 is a cross sectional view of the spin assembly.

FIG. 12 shows the past hub 4000 supporting axle 24. The adjustable lock nut 4001 secures the axle 24 to the post hub 4000. Wheel hub 4003 is the center of the big wheel 7.

Figure 13:
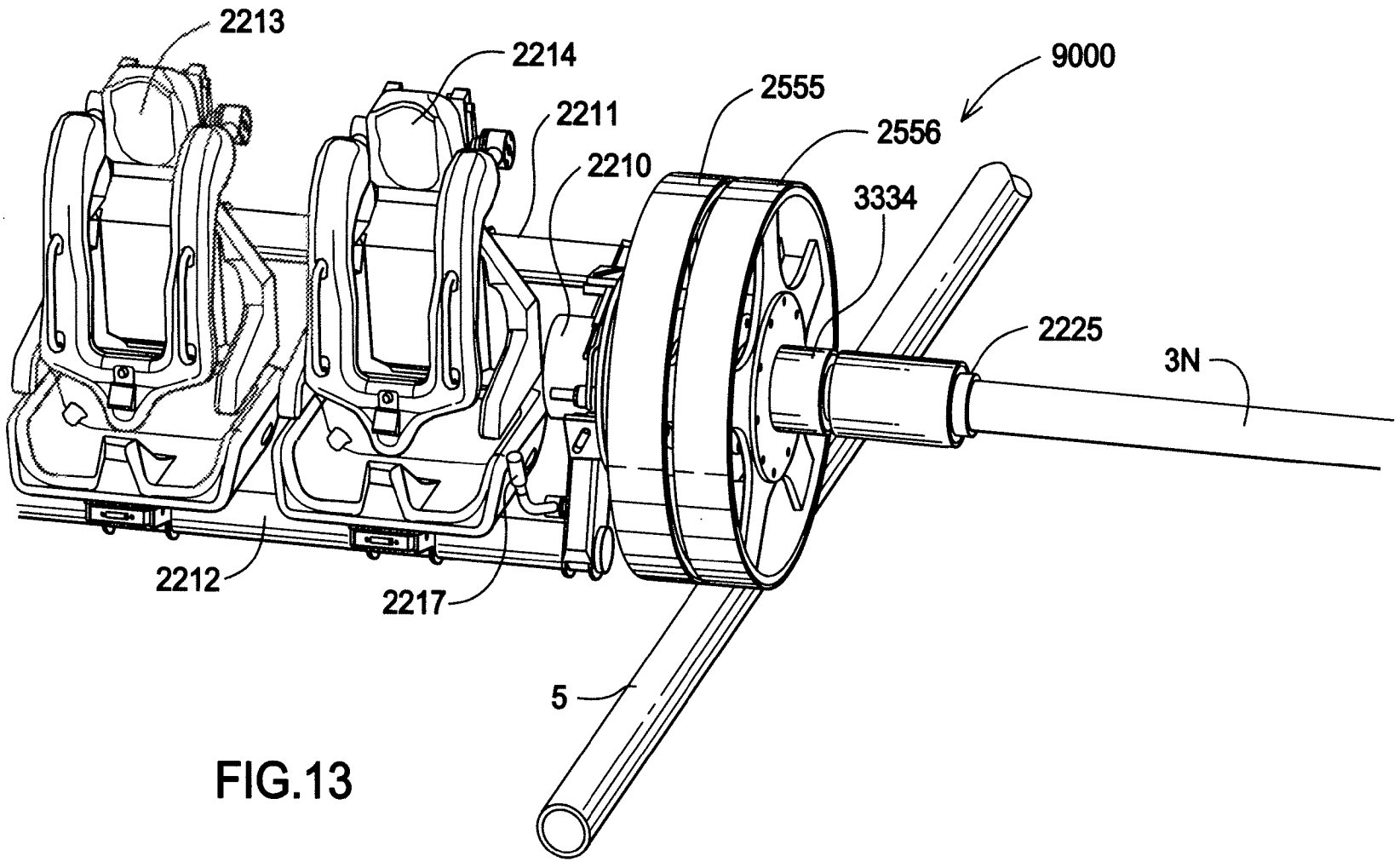
FIG. 13 is a front perspective view of a dual small wheel embodiment.
Figure 14:
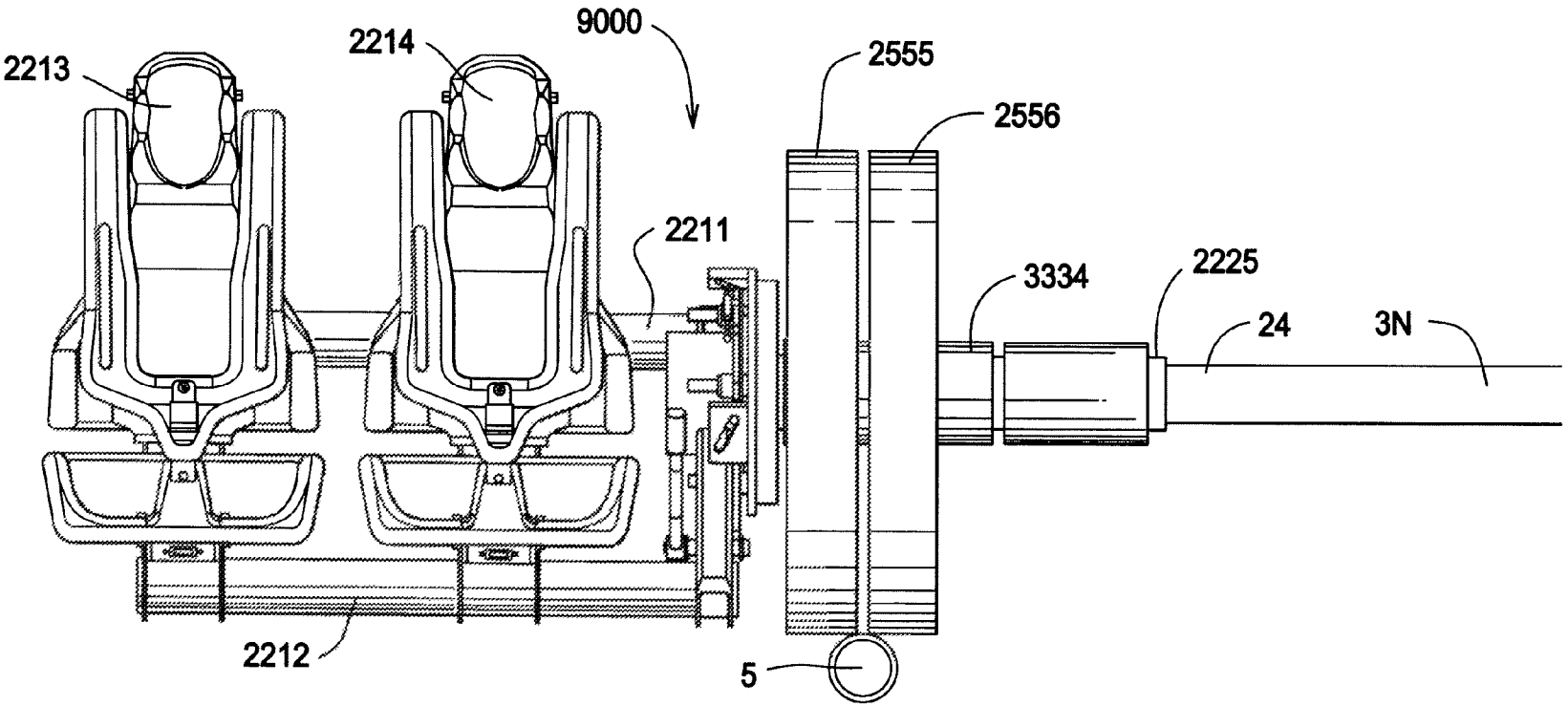
FIG. 14 is a front plan view of the FIG. 13 embodiment.
Figure 15:
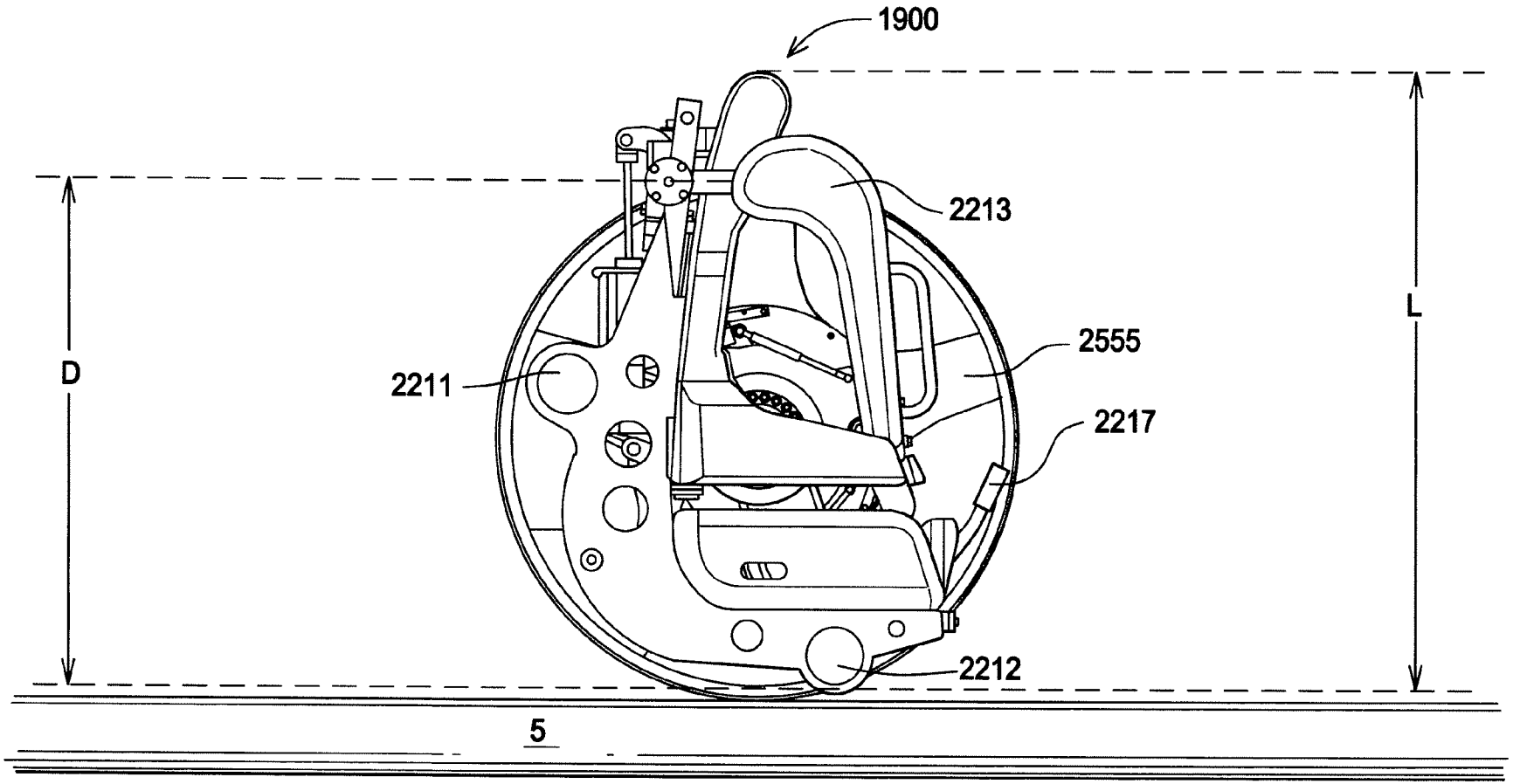
FIG. 15 is a side plan view of the FIG. 13 embodiment.

Referring next to FIGS. 13, 14, 15 a conveyance 9000 has one or more small wheels 2555, 2556 sharing a common axle 24. Small is defined as a diameter equal to or less than the height L of the rider conveyance 1900. The wheel hub 3334 is part of second (optional) wheel 2556. Support track 5 is sized to support whatever wheel(s) width is chosen by the designer.

Figure 16:
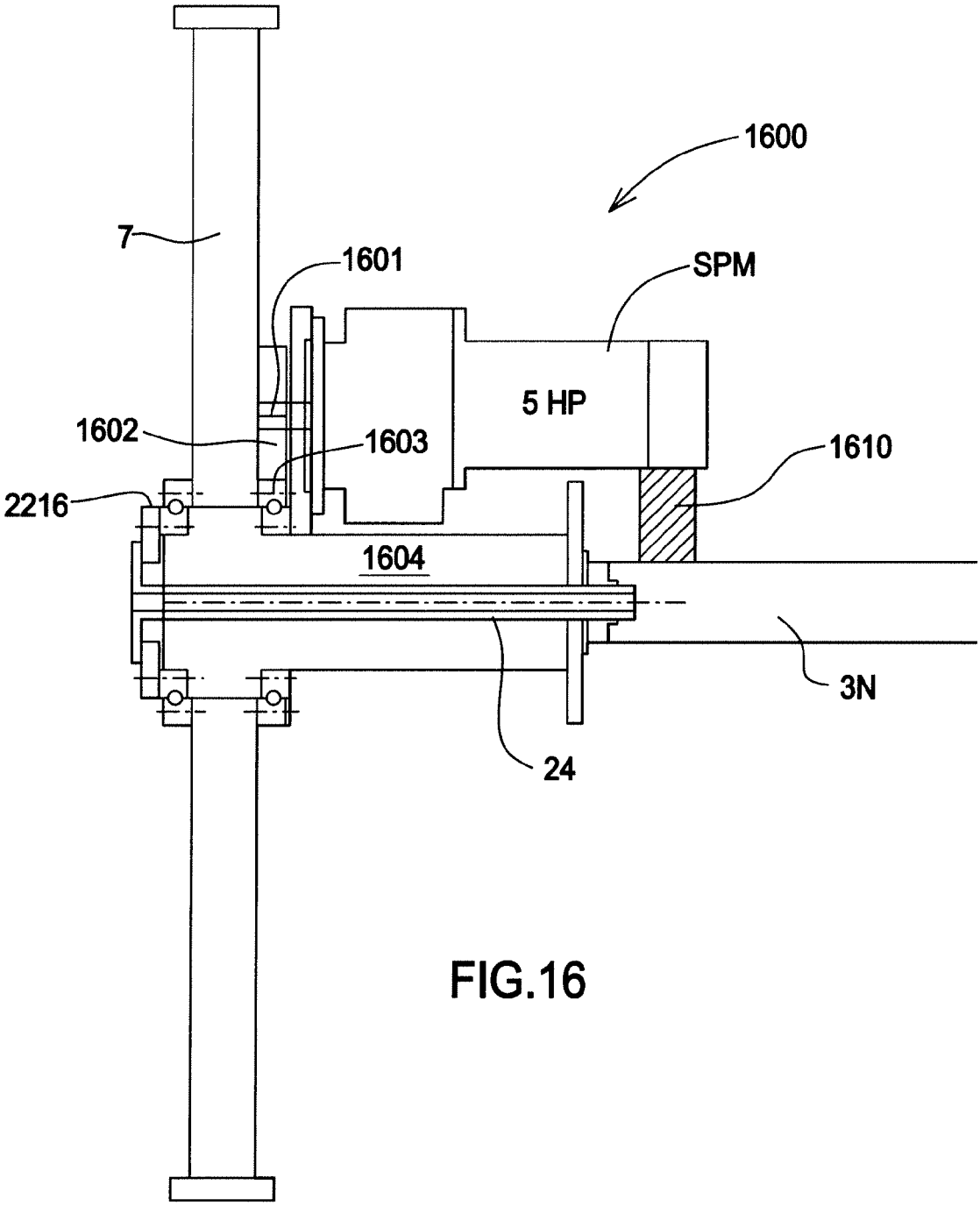
FIG. 16 is a partial cutaway view showing the front of a self propelled big wheel 7. The seat ride apparatus is the same as FIG. 8.

Central to the invention's concept is that any sized wheel or wheels support an axle 24 which in turn supports a rider frame 2211. Equivalent to an axle 24 support the frame 2211, a hub 3334 (on the other side of the wheel) could also support a rider frame 2211 in mid air as shown in FIG. 13. This free flight thrill to the rider is unique in a roundabout type ride. Referring next to FIG. 16 a self propelled embodiment 1600 may not have a central drive motor M as shown in FIG. 4B. In place of motor M or in addition to motor M, one or more big wheels 7 has a self propelling motor SPM. The radius arm 3N supports motor SPM with a bracket 1610. The motor SPM has a drive shaft 1601 which powers a drive wheel 1602. The drive wheel 1602 turns a collar 1603 on the big wheel 7. A hub 1604 is attached to the axle 24. The hub 1604 supports the collar 1603.

In its broadest concept the unique conveyance could be rolled down a hill and/or pushed along a path. A ground version could use a counterweight and a pilot wheel attached to the opposite end of the axle as the rider frame.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

We claim:

1. A roundabout ride comprising:

a track having a constant radius length from a central hub;

said central hub having a plurality of radius arms affixed to the hub;

said central hub having a power source to rotate the central hub;

each radius arm having an outbound end affixed to an axle of a wheel which rides on the track;

said axle of said wheel having an axle assembly including an extension which supports a rider carriage on one side of the wheel;

said axle assembly further comprising a gimbaled support for the rider carriage;

wherein the axle provides the exclusive support for the rider carriage;

wherein the rider carriage is suspended exclusively by the axle and has no support means beneath it; and wherein the rider compartment is able to spin 360° either forward or backward.

2. The apparatus of claim 1, wherein the axle assembly further comprises a spin mechanism functioning to engage and disengage the rider compartment momentarily with the wheel while the wheel is traveling on the track, thereby imparting the 360° spin to the rider compartment either forward or backward.

3. The apparatus of claim 1 wherein the rider can use a control mechanism to control the spin of the rider compartment.

4. The apparatus of claim 1, wherein the track has a hilly contour, and each radius arm has an inbound end, with a pivotable connection to the hub, thereby enabling the wheel to travel up and down around the track.

5. The apparatus of claim 1, wherein the rider carriage supports a rider in an open seat, thereby imparting a free flight sensation to the rider.

6. The apparatus of claim 5, wherein the wheel has a diameter which is greater than a height of the rider carriage.

7. A roundabout ride comprising:

a powered central hub which provides a rotational movement to a radius arm;

said radius arm having an outbound end attached to a wheel traveling along a support surface;

said wheel having an axle assembly which supports a rider seat outbound from the wheel;

said axle assembly having a gimbaled bearing to allow the seat to rock;

wherein the axle provides the exclusive support for the rider carriage; and wherein the rider carriage is suspended exclusively by the axle and has no support means beneath it; and wherein the rider compartment is able to spin 360° either forward or backward.

8. The apparatus of claim 7, wherein the axle assembly further comprises a spin mechanism to engage the seat with the wheel to impart the 360° spin to the seat either forward or backward.

9. The apparatus of claim 7, wherein the support surface further comprises a circular track having a hilly contour.

10. The apparatus of claim 7, wherein the wheel has a diameter of greater than five feet.

11. The apparatus of claim 9, wherein the track is supported above a ground surface.

12. A roundabout ride comprising:

a track having a constant radius length from a central hub;

said central hub having a plurality of radius arms affixed to the hub;

hub;

each radius arm having an outbound end affixed to an axle of a wheel which rides on the track;

said axle of said wheel having an axle assembly including an outbound extension which supports a rider carriage and an inbound bracket which supports a self propelling motor;

said axle assembly further comprising a gimbaled support for the rider carriage;

wherein said rider carriage provides a rocking motion as the central hub rotates;

wherein the self propelling motor moves the wheel around the track;

wherein the rider carriage is suspended exclusively by the axle and has no support means beneath it; and wherein the rider compartment can spin a 360° either forward or backward.

13. The apparatus of claim 12, wherein the axle assembly further comprises a spin mechanism functioning engages and disengages the rider compartment momentarily with the wheel while the wheel is traveling on the track, thereby imparting the 360° spin to the rider compartment either forward or backward.

14. The apparatus of claim 12, wherein the track has a hilly contour, and each radius arm has an inbound end, with a pivotable connection to the hub, thereby enabling the wheel to travel up and down around the track.

15. The apparatus of claim 12, wherein the rider carriage supports a rider in an open seat, thereby imparting a free flight sensation to the rider.

16. The apparatus of claim 15, wherein the wheel has a diameter which is greater than a height of the rider carriage.

17. An amusement ride comprising:

a conveyance rail and a wheel rollable over the conveyance rail;

said wheel having a hub assembly supporting a rider frame on one side of the wheel, said wheel and said hub assembly having a single axle;

said rider frame having a rider support to hold a rider during a ride;

wherein the wheel is raised to a high point of the conveyance rail assembly and released to ride along the conveyance rail as guided;

wherein the axle which provides the exclusive support for the rider frame;

wherein the rider support is suspended exclusively by the axle and has no support means beneath it; and the rider frame can be selectively flipped around 360°.

18. The apparatus of claim 17, wherein the conveyance rail further comprises a closed loop track having a hilly contour.

19. The apparatus of claim 18, wherein the track is circular.

20. The apparatus of claim 19 further comprising:

the track having a constant radius length from a central hub;

said central hub having a plurality of radius arms affixed to the hub;

said central hub having a power source to rotate the central hub; and each radius arm having an outbound end affixed to the axle of the wheel which rides on the track.

21. An amusement ride comprising:

a conveyance rail and a large wheel rollable on the conveyance rail;

said large wheel having an axle supporting a rider frame on one side;

said axle being the exclusive support for the rider frame;

wherein the rider frame supports a holder for a rider;

wherein the rail assembly has a hoist means functioning to raise the large wheel to a high point and release it to travel down the conveyance rail;

the rider frame having a flip mechanism connected to the axle functioning to selectively engage the rider frame to the large wheel, thereby flipping the rider frame around; and wherein the conveyance rail forms a closed loop track.

22. The amusement ride of claim 21 further comprising:

a central hub which provides a rotational movement to a radius arm;

said radius arm having an outbound end attached to the wheel.

* * * * *